United States Patent [19]

Owen et al.

[11] Patent Number: 4,963,696

[45] Date of Patent: Oct. 16, 1990

[54] TAMPER RESISTANT PADMOUNTED TRANSFORMER

[75] Inventors: Timothy C. Owen, Jefferson City; Virgil L. Borgmeyer, Meta; Herbert S. Adkins, Vienna, all of Mo.

[73] Assignee: ABB Power T&D Company, Inc., Blue Bell, Pa.

[21] Appl. No.: 419,917

[22] Filed: Oct. 11, 1989

[51] Int. Cl.[5] ..... H01F 27/02

[52] U.S. Cl. ..... 174/50; 277/189; 336/90

[58] Field of Search ..... 174/17 CT, 50, 52.1; 220/85 TC; 336/65, 90; 277/181, 186, 189

[56] References Cited

U.S. PATENT DOCUMENTS 2,705,655 4/1955 Brown et al. ..... 277/189 X

FOREIGN PATENT DOCUMENTS 40448 8/1965 Fed. Rep. of Germany ..... 277/189

*Primary Examiner*—Laramie E. Askin

*Attorney, Agent, or Firm*—Sixbey, Friedman, Leedom & Ferguson

[57] ABSTRACT

A tamper-resistant three-phase padmounted transformer is provided including a tank having electrical connections mounted on one wall thereof, and a cabinet fixedly attached to the tank forming a cabinet-to-tank interface therebetween. An elongated P-shaped gasket is positioned at the interface so as to completely fill such interface, and a rib is secured to the cabinet for overlying the interface to form a tamper-resistant cabinet-to-tank interface which prevents the intrusion of extraneous objects into the interior of the cabinet.

26 Claims, 4 Drawing Sheets

TAMPER RESISTANT PADMOUNTED TRANSFORMER

BACKGROUND OF THE INVENTION

This invention generally relates to electrical transformers, and more specifically to three-phase padmounted transformer with a specially designed rib and gasket for preventing the insertion of extraneous objects in cabinet area of such transformers.

In recent years many new residential and commercial developments in both the U.S. and foreign countries have recognized the beneficial attributes of underground electrical service and have emphasized the use of such service. Systems of this type eliminate the need for pole lines and above-ground wiring which inherently detract from the overall appearance of both residential as well as commercial developments. Adoption of such underground electrical systems has necessitated the development of above-ground transformers which are not raised by utility poles but are positioned on ground surface platforms. Because these transformers are often positioned on the property of resident owners, the most significant problem facing the use of platform-mounted or padmounted transformers is that they may fascinate children and lure them into tampering with such transformers. Further, such transformers may be subjected to vandals who may attempt to pry open the transformer by inserting an extraneous object into an interface between components of the transformer. Consequently, there is an ever-present need to provide tamper-resistant padmounted transformers which can be safely and confidently placed in residential areas.

The necessity of tamper-resistant padmounted transformers has been recognized in the art as is shown in U.S. Pat. No. 4,267,399 issued to Robert J. Lux, Jr. Therein, a hollow sleeve is positioned about the cables which enter and exit the cabinet portion of the transformer. The sleeve extends above the top surface of the cement pad such that wires or other long slender implements which are pushed between the lower edge of the transformer housing and the top surface of the pad are prevented from contacting the cables. However, the sleeve cannot prevent extraneous objects from being inserted into the seam interface between the cabinet and tank of the transformer.

In U.S. Pat. No. 4,556,758, issued to Gary A. Warden, and assigned to Westinghouse Electric Corporation, a tamper-resistant cabinet-to-tank interface is disclosed. Therein, a hinged joint is required at the cabinet-to-tank interface with the interface being formed by two equal, oppositely facing acute angles formed in the cover, an a single obtuse angle. When the cabinet is pivoted about the hinged joint, a leg of the obtuse angle enters the vertex of an acute angle thereby creating an obstructed path whereby any elongated objects, such as a wire, cannot be readily extended into the cabinet-to-tank interface. However, with the above-mentioned interface, hinges are required to hold the two components together and form the only contact between the cabinet and cover. Care must be taken during the manufacture of such an interface to ensure proper alignment between the obtuse and cooperating acute angles.

With three-phase transformer cabinetry as is shown in FIG. 1, the cabinet portion of the transformer extends above the tank portion and includes a lockable front door for allowing authorized personnel access to the interior of the cabinet. A back baffle of the cabinet is bolted to an upper side portion of the transformer, as shown in FIG. 3, with a cork gasket positioned therebetween to prevent foreign objects from being inserted into the cabinet at the cabinet-to-tank interface. However, with the cork gasket, additional adjustment is sometimes required at assembly due to misalignments of tank and cabinet.

In view of the foregoing, it is clear that there is a need for both an economical and a more reliable construction for preventing unauthorized intrusion at the cabinet-to-tank interface of a padmounted three-phase transformer resulting in a tamper-resistant unit which may be safely and confidently used in both commercial and residential areas.

SUMMARY OF THE INVENTION

It is a primary object of the present invention to provide a tamper-resistant padmounted transformer which overcomes the shortcomings associated with the prior art discussed above. Particularly, the padmounted transformer in accordance with the present invention includes an elongated gasket which is positioned within the interface formed between a tank portion and a cabinet portion of a three-phase transformer. Additionally, a flange or rib is secured to a back panel of the cabinet portion of the transformer such that the rib overlies the interface between the tank and cabinet as well as the gasket.

Another object of the present invention is to provide an improved gasket for completely covering the cabinet-to-tank interface at the top edge of the tank as well as one which is capable of compensating for any misalignment at the interface. This is accomplished in accordance with the present invention by providing a P-shaped gasket which is held in place by a back plate or panel of the cabinet such that the extended portion of the P-shaped gasket is pressed against an upper curved portion of the tank. Thereby, any slight misalignment between the tank and the cabinet will be compensated for by the P-shaped gasket, and the gasket will also prevent any extraneous objects from being inserted between the tank and the cabinet.

A further object of the present invention is to provide a tamper-resistant rib which may be readily adapted to present operational padmounted transformers. To accomplish such in accordance with the present invention, a rib in the form of an elongated bar may be readily secured, by way of welding or other process, to the back panel of existing three-phase transformer cabinets. The bar is positioned to overlie the cabinet-to-tank interface and consequently prevents the forcing of any extraneous object straight into the cabinet area.

Yet another object of the present invention is to provide a reliable tamper-resistant padmounted transformer which is also economical to manufacture. This is accomplished in accordance with the present invention by integrally forming a rib in the back panel of newly manufactured three phase transformer cabinets. Again, this rib is positioned to overlie the cabinet-to-tank interface to prevent the forcing of any extraneous objects straight into the cabinet area.

By providing a three-phase padmounted transformer with the above-mentioned features, it will be impossible to force a wire or other elongated foreign object directly down into an innerspace of the cabinet portion of the transformer. These features will also significantly deter any angled insertions.

These as well as additional advantages of the present invention will become apparent from the figures and the following descriptions of the preferred embodiments.

DETAILED DESCRIPTION OF THE PREFERRED EMBODIMENTS

Figure 1:
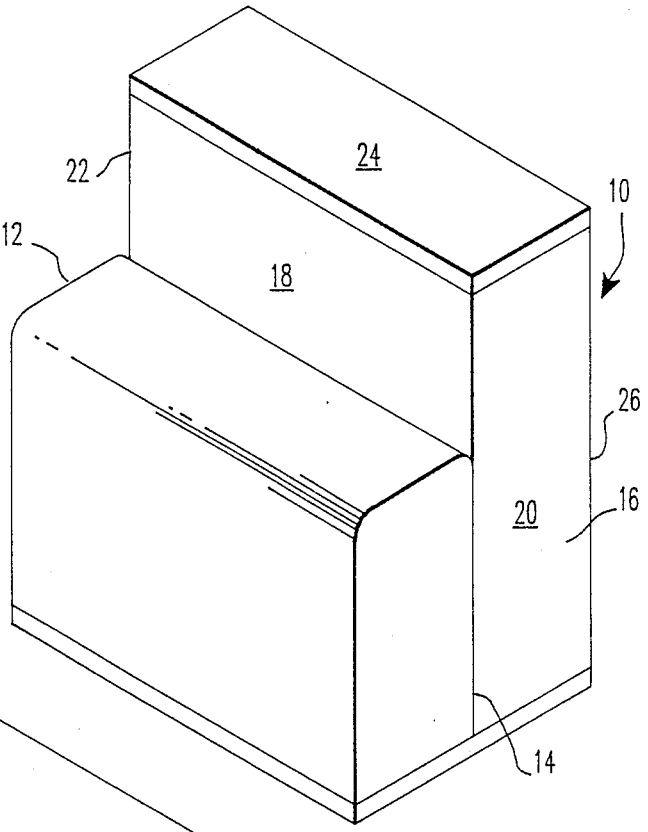
FIG. 1 PRIOR ART
FIG. 1 is a perspective view of a conventional three-phase padmounted transformer.
Figure 2:
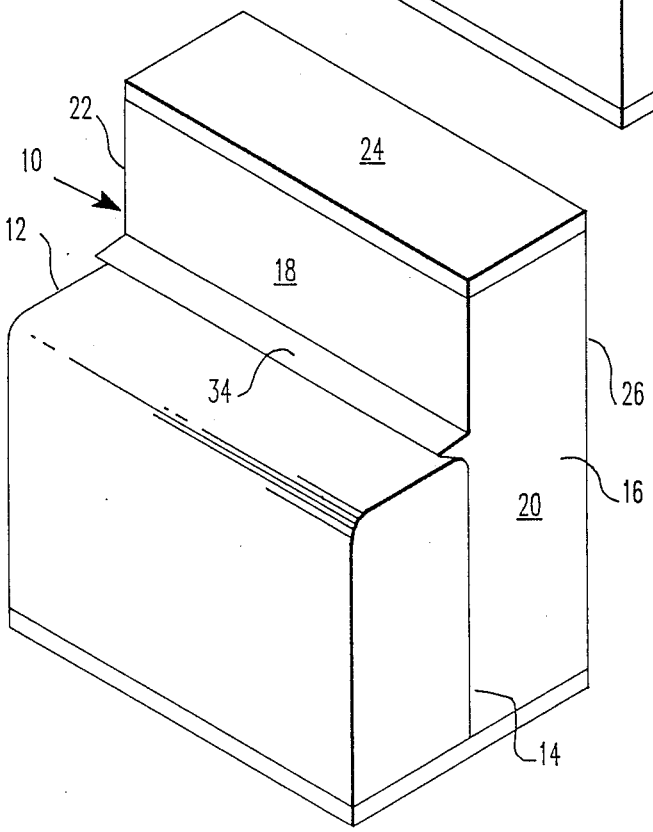
FIG. 2 is a perspective view of a three-phase padmounted transformer incorporating the tamper-resistant features in accordance with the present invention.

Referring now to the drawings, and to FIGS. 1 and 2 in particular, there is shown a padmounted three-phase electrical distribution transformer 10 which includes an enclosed metallic tank 12 having front surface 14. The tank 12 contains conventional couplings (not shown) such as electrical terminals in the form of high voltage bushings and low voltage bushings, and a core-coil assembly immersed in a suitable liquid dielectric such as mineral oil. The core-coil assembly includes a primary winding which is connected to the high voltage bushings and a secondary winding which is connected to the low voltage bushings. As previously mentioned, these bushings are mounted on the front surface 14 of the tank 12 so as to be accessible from an interior of a cabinet 16.

The cabinet 16 is formed adjacent to the front surface 14 of the tank 12 for enclosing the bushings and providing a space for cables which ascend from the ground to be connected to the bushings. As shown in FIGS. 1 and 2 as well as FIGS. 3 and 4, the cabinet 16 includes a back plate or panel 18, side panels 20 and 22, a top panel 24 and a front panel 26 which includes access doors 28 which may be hingedly connected or slidably connected to the front panel 26.

Figure 3:
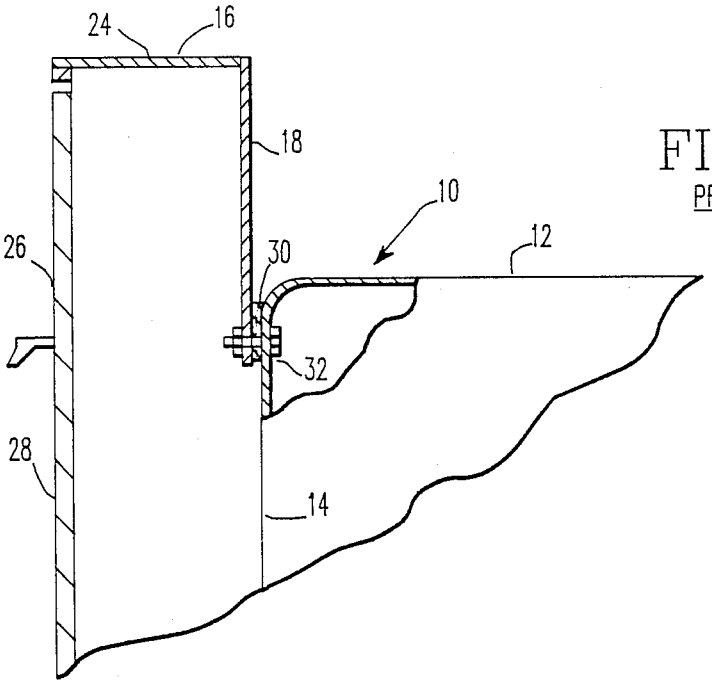
FIG. 3 PRIOR ART
FIG. 3 is partial cross-sectional view of the three-phase padmounted transformer shown in FIG. 1.

As can be seen from FIG. 3, a conventional three-phase padmounted transformer includes a planer cork gasket 30 within the cabinet-to-tank interface which is secured therebetween by a plurality of studs 32. However, as discussed previously, because the studs 32 are spaced apart, it may be possible that a wire or other elongated extraneous object may be forced between the back panel 18 of the cabinet 16 and the front panel 14 of the tank 12 so as to come in contact with the previously mentioned high voltage and low voltage bushings. If such should occur, a high voltage would be transmitted through the wire and into the body of the unauthorized person tampering with the transformer.

Figure 4:
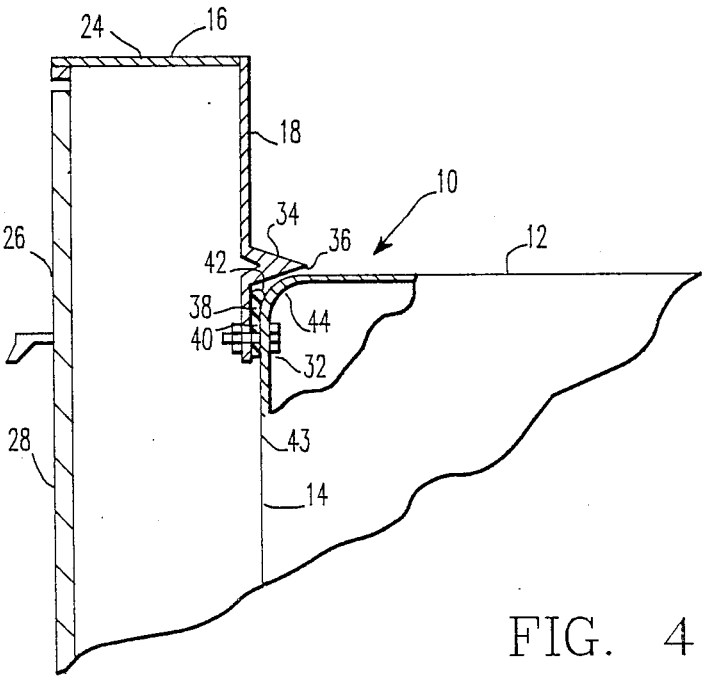
FIG. 4 is a partial cross-sectional view of the three-phase padmounted transformer of FIG. 2 in accordance with the present invention.
Figure 6:
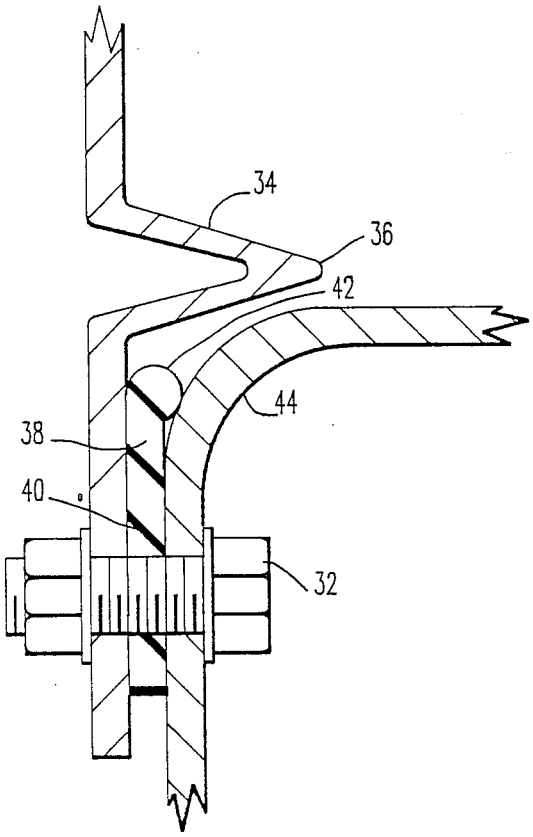
FIG. 6 is an exploded cross-sectional view of the tamper-resistant feature shown in FIG. 4 in accordance with the present invention.
Figure 8:
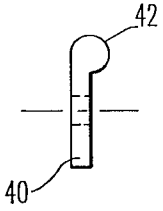
FIG. 8 is an elevational side view of the P-shaped gasket shown in FIG. 7.
Figure 7:
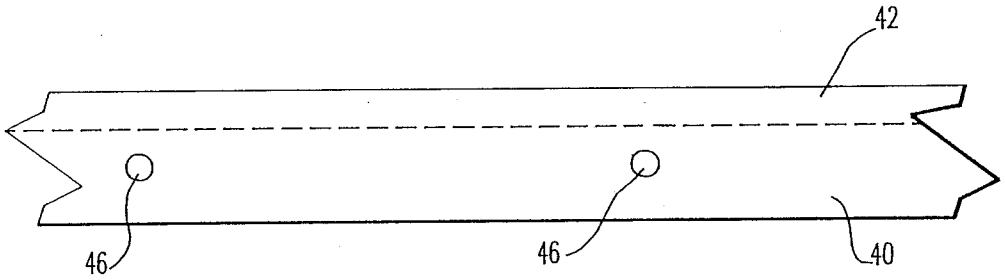
FIG. 7 is a partial elevational view of the P-shaped gasket in accordance with the preferred embodiment of the present invention.

Turning now to FIGS. 2, 4 and 6, a preferred embodiment of the present invention will be described in greater detail. As can be seen in FIG. 2, a flange or rib 34 is positioned to extend the entire length of the back panel 18 of the cabinet so as to overlie the cabinet-to-tank interface and prevent the above-mentioned forcing of extraneous objects into the inner portion of the cabinet 16. As can be better seen in FIGS. 4 and 6, the rib 34 is integrally formed in the back panel 18 of the cabinet 16 with a forward tip 36 of the rib 34 extending a sufficient distance so as to completely overly the cabinet-to-tank interface. Further, in conjunction with the rib 34 an elongated P-shaped gasket 38 is provided in place of the previously described cork gasket 30. The P-shaped gasket which is better illustrated in FIGS. 7 and 8 includes an elongated planar portion 40 and an elongated extension portion 42. The P-shaped gasket extends the entire length of the back panel 18 of the cabinet 16 so as to completely fill the cabinet-to-tank interface. As can be seen from FIGS. 4 and 6, the tank includes a vertically extending portion 43 and curved corner portion 44 which when positioned adjacent the back panel 18 of the cabinet 16, results in the interface area being susceptible to forcible entry. By providing the P-shaped gasket 38, when the back panel 18 of the cabinet 16 is secured to the front panel 14 of the tank 12 by way of studs 32, the elongated extension portion 42 of the P-shaped gasket will be compressed within the interface area.

The P-shaped gasket 38 includes a plurality of bores 46 for receiving the studs 32 such that the P-shaped gasket 38 may be readily positioned between the back panel 18 and front panel 14. In order to be properly positioned within present three-phase padmounted transformers, the bores 46 would be approximately 0.44 inch (1.118 cm) in diameter and spaced approximately 10.0 inches (25.4 cm) apart with the overall length of the P-shaped gasket 38 being approximately 54.5 inches (138.43 cm). Further, in order for the P-shaped gasket 38 to properly fill the void at the cabinet-to-tank interface, the gasket 38 need be approximately 1.25 inches (3.175 cm) in height with the elongated extension 42 portion having a diameter of approximately 0.37 inch (0.9398 cm). However, these values will vary depending upon the specific structure of the transformer. The P-shaped gasket may be formed of any conventional gasket material such as cork, rubber or synthetic material and may be cut or preferably extruded to form the single piece elongated gasket necessary for forming the tamper-resistant seal between the cabinet and tank of the three-phase padmounted transformer.

As can be seen from the Figures, it is impossible to force a wire or other extraneous object directly downward into the cabinet-to-tank interface. For an extraneous object to be forced through the cabinet-to-tank interface, it must be bent at a 90° angle before entering into the cabinet compartment, which would result in the force exerted being insufficient to overcome the compression fit of the P-shaped gasket 38. Moreover, by positioning the rib 34 to overly the P-shaped gasket 38, this gasket will be protected from vandalism as well as corrosive environmental effects.

Figure 5:
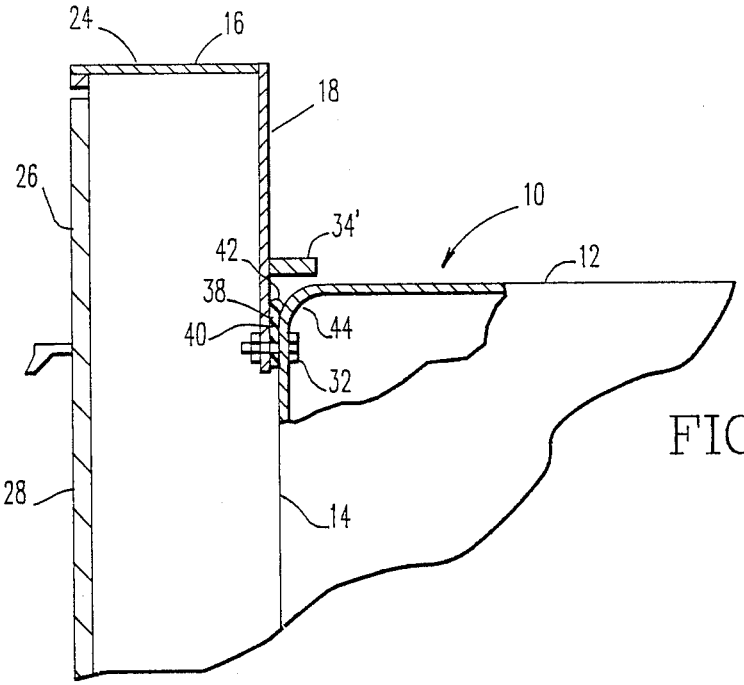
FIG. 5 is a partial cross-sectional view of the three-phase padmounted transformer in accordance with an alternative embodiment of the present invention.

An alternative embodiment of the rib illustrated in FIGS. 4 and 6 is set forth in FIG. 5. The rib 34' is composed of an elongated bar which is fixedly secured to the back panel 18 by way of welding or other conventional securing process. The bar 34' performs the identical function as that of the integrally formed rib 34 and overlies the cabinet-to-tank interface. It should be noted that the rib 34' may be readily secured to presently existing three-phase padmounted transformers.

Because the P-shaped gasket completely fills the previous open area between the curved portion 44 and the back panel 18 and the rib 34 or 34' overlies the entire cabinet-to-tank interface, it is impossible to extend an elongated extraneous object into an interior portion of the cabinet which may result in severe electrical shock to the unsuspecting unauthorized individual. Consequently, a highly tamper-resistant cabinet-to-tank interface is formed in accordance with the present invention. This will allow both present and future three-phase transformers to be safely and confidently used in both commercial and residential areas where such transformers may fascinate and lure unsuspecting individuals to tamper with such transformers.

While the invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. A temper-resistant transformer comprising;

a tank having at least one electrical connection on a wall thereof, a cabinet having a wall fixedly attached to said tank wall and forming an interface therebetween, and an elongated gasket disposed over said interface and including a first elongated section and a second elongated section, wherein when viewed in cross-section said second elongated section includes at least one extension portion which extends beyond a plane formed by said first elongated section.

2. The transformer as defined in claim 1, wherein said gasket when viewed in cross-section is P-shaped.

3. The transformer as defined in claim 1, wherein said cabinet wall includes a planar portion and said wall of said tank includes a curved portion which abuts to form said interface, and said first elongated section of said gasket abuts said planar portion and said extension portion of said second section of said gasket abuts said curved portion along the lengths of both the curved portion and the planar portion

4. The transformer as defined in claim 1, wherein said cabinet is of a greater vertical height than the height of said tank.

5. The transformer as defined in claim 4, further comprising a flange extending from said cabinet wall and overlying said gasket.

6. The transformer as defined in claim 5, wherein said flange is an elongated rib secured to said cabinet wall.

7. The transformer as defined in claim 6, wherein said rib is welded to said cabinet wall.

8. The transformer as defined in claim 6, wherein said rib is integrally formed in said cabinet wall.

9. A tamper-resistant transformer of the type having at least two exterior walls that mutually abut in parallel relationship at one portion thereof and then diverge apart at another portion thereof, wherein an interface is defined between said walls at the point of divergence, comprising:

an elongated gasket disposed over said interface and including a first elongated section and a second elongated section, wherein when viewed in cross-section said second elongated section includes at least one extension portion which extends beyond a plane formed by said first elongated section.

10. A temper-resistant transformer comprising;

a tank having at least one electrical connection on a wall thereof, a cabinet fixedly attached to said wall and forming an interface therebetween, said cabinet being of a greater vertical height than the height of said tank, and a flange extending from said cabinet and overlying said interface between said cabinet and said tank to form a tamper-resistant cabinet-to-tank interface.

11. The transformer as defined in claim 10, wherein said cabinet includes a back panel and said flange is an elongated rib secured to said back panel.

12. The transformer as defined in claim 11, wherein said rib is welded to said back panel.

13. The transformer as defined in claim 11, wherein said rib is integrally formed in said back panel.

14. The transformer as defined in claim 10, further comprising an elongated gasket positioned at said interface between said wall of said tank and said cabinet.

15. The transformer as defined in claim 14, wherein said elongated gasket includes a first elongated section and a second elongated section which when viewed in cross-section said second elongated section includes at least one extension portion which extends beyond a plane formed by said first elongated section.

16. The transformer as defined in claim 15, wherein said gasket when viewed in cross-section is P-shaped.

17. The transformer as defined in claim 15, wherein said wall of said tank includes a planar portion and a curved portion, and said first elongated section of said gasket abuts said planar portion and said extension portion of said second elongated section of said gasket abuts said curved portion along the length of said curved portion.

18. A tamper-resistant padmounted transformer comprising;

a tank having electrical connection means on a wall thereof;

a cabinet fixedly attached to said wall forming an interface therebetween, said cabinet being of a greater vertical height than the height of said tank, an elongated gasket positioned within said interface; and a flange extending from said cabinet and overlying said interface and said gasket to form a tamper-resistant transformer.

19. The transformer as defined in claim 18, wherein said cabinet includes a back panel and said flange is an elongated rib secured to said back panel.

20. The transformer as defined in claim 19, wherein said rib is welded to said back panel.

21. The transformer as defined in claim 19, wherein said rib is integrally formed in said back panel.

22. The transformer as defined in claim 18, wherein said elongated gasket includes a first elongated section and a second elongated section which when viewed in cross-section said second elongated section includes at least one extension portion which extends beyond a plane formed by said first elongated section.

23. The transformer as defined in claim 22, wherein said gasket when viewed in cross-section, is P-shaped.

24. The transformer as defined in claim 22, wherein said wall of said tank includes a planar portion and a curved portion, and said first elongated section of said gasket abuts said planar portion and said extension portion of said second elongated section of said gasket abuts said curved portion along length of the curved portion.

25. A tamper-resistant transformer of the type having at least two exterior walls that mutually abut in parallel relationship at one portion thereof and then diverge apart at another portion thereof, wherein an interface is defined between said walls at the point of divergence, comprising:

a flange extending from one of said walls and overlying said interface to form a tamper-resistant structure over said interface.

26. The transformer as defined in claim 25, further comprising an elongated gasket disposed over said interface and including a first elongated section and a second elongated section, wherein when viewed in cross-section said second elongated section includes at least one extension portion which extends beyond a plane formed by said first elongated section.

* * * * *